United States Patent [19]

Budinger et al.

[11] Patent Number: 4,710,679

[45] Date of Patent: Dec. 1, 1987

[54] FLUORESCENT LIGHT SOURCE EXCITED BY EXCIMER EMISSION

[75] Inventors: A. Bowman Budinger, Westford; Walter P. Lapatovich, Hudson, both of Mass.

[73] Assignee: GTE Laboratories Incorporated, Waltham, Mass.

[21] Appl. No.: 806,048

[22] Filed: Dec. 6, 1985

[51] Int. Cl.[4] ..... H01J 7/44; H01J 13/36; H01J 17/78; H01J 29/96; H01K 1/62

[52] U.S. Cl. ..... 315/58; 313/17; 313/637; 313/638; 313/641; 315/248

[58] Field of Search ..... 313/636, 637, 638, 641, 313/17; 315/248, 58

[56] References Cited

U.S. PATENT DOCUMENTS

| | | | |
|---|---|---|---|
| 3,581,137 | 5/1971 | Arnott et al. | 313/109 |
| 3,586,898 | 6/1971 | Speros | 313/636 |
| 4,427,924 | 1/1984 | Proud et al. | 315/248 |
| 4,480,213 | 10/1984 | Lapatovich et al. | 315/248 |
| 4,490,642 | 12/1984 | Dobrusskin et al. | 313/637 |
| 4,492,898 | 1/1985 | Lapatovich et al. | 315/248 |
| 4,510,418 | 4/1985 | Anderson, Jr. et al. | 315/73 |
| 4,549,109 | 10/1985 | Nighan et al. | 313/637 |

OTHER PUBLICATIONS

"Excimer Fluorescence for Plasma Displays", W. L. Nighan & C. M. Ferrar, *Appl. Phys. Lett.*, 40(3), Feb. 1982, *American Inst. of Physics.*

"Rare Gas Halogen Excimers", by Ch. K. Rhodes, from Text Excimer Lasers, entitled *Topics in Applied Physics*, vol. 30, Springer Verlag, Berlin, N.Y. (1979), pp. 88–110.

"The Laser vs. the Lamp: A Novel Laser-Induced Adiabatic Reaction and Luminescence of Benzophenone", N. J. Turro et al., *Journal of the American Chemical Society*, vol. 104, No. 3, pp. 856–858 (1982).

"Optical Emissions of Triatomic Rare Gas Halides", Lorents et al., *J. Chem. Phys* 68(10), May 15, 1978, pp. 4657–4661.

"A Troatp,oc $Xe_2Cl$ Excimer Laser in the Visible", Tittel et al., *Appl. Phys. Lett.*, 36(6), Mar. 15, 1980, pp. 405–407.

Carl M. Ferrar & William L. Nighan, 1982 International Display Research Conference Proceedings, Cherry Hill, N.J., Oct. 19–21, 1982, IEEE CH 1790-5/82/00-00-0101, pp. 101–106.

*Primary Examiner*—Saxfield Chatmon

*Attorney, Agent, or Firm*—Hamilton, Brook, Smith & Reynolds

[57] ABSTRACT

A fluorescent lamp is described in which spontaneous excimer UV emission in an inner tube results from reacting an inert gas molecule with a halide molecule in the excited state. The UV emission travels through the inner tube envelope to an outer tube and is absorbed by a fluorescent material, i.e., phosphor, to produce visible light which passes through the outer tube envelope. The halide may be supplied by metal halide pellets or liquid droplets, which when heated by an initial discharge through an inert gas, produces metal halide vapors which dissociate and combine with the inert gas (Xe, Ar, Ne, Kr) in the excited state and result in UV excimer emission.

12 Claims, 2 Drawing Figures

FLUORESCENT LIGHT SOURCE EXCITED BY EXCIMER EMISSION

DESCRIPTION

1. Technical Field

This invention is in the field of electric light sources or lamps and in particular, fluorescent lamps.

2. Background Art

Conventional fluorescent lamps comprise a tubular sealed glass or quartz envelope interiorly coated with a suitable phosphor that is responsive to UV radiation. The UV radiation (254 nm) arises from excited Hg (mercury) in all conventional low pressure fluorescent lamps. The tube is filled with a predetermined amount of mercury and a suitable starting gas, such as, neon at a fill pressure of about 2 Torr. Electrodes are provided at opposite ends of the tube. A glow discharge is established across the electrodes causing UV radiation to be emitted from the mercury vapor. The UV radiation impinging on the phosphor, in turn, causes visible radiation to be emitted from the phosphor which passes through the glass envelope to provide visible illumination.

The diameter of such conventional fluorescent lamps is limited by self-absorption of the mercury UV emissions.

"Excimer" lasers have recently been developed in which the active laser gaseous medium consists of diatomic molecule or "dimers". An excimer medium is a "bound-free" system, in that the atoms of the medium, when in their ground state, repel one another at interatomic distances. When atoms are excited, the atomic state is modified so that there is an attractive force between other atoms in the gas. Atoms are then bound together at a small separation distance, creating an excited-state dimer or "excimer". An "excimer" is then a diatomic molecule bound in the excited state and either weakly bound or completely unbound in the ground state. (For purposes of this description, the term "excimer" also includes triatomic and more complex "bound-free" ground state systems sometimes referred to in the art as "exciplex".) Excimer molecules typically radiate in the ultraviolet spectrum over a large bandwidth. In special circumstances, this radiation may be compressed into a spectrally narrow line. This situation gives rise to the class of lasers known as "excimer lasers".

DISCLOSURE OF THE INVENTION

The present invention utilizes incoherent spontaneous UV emission from excimers to excite phosphors and produce fluorescent visible light. More specifically, a lamp is provided, consisting, in general, of an elongated outer tubular envelope internally coated with phosphor and an inner elongated tubular envelope, coaxial with the outer envelope, containing a rare gas and a volatile halogen donor (i.e., halogen containing molecule) in solid or liquid form within the inner envelope. A pair of electrodes are provided within the inner envelope at opposite ends thereof.

An outer coaxial chamber is formed between the inner and outer envelopes. This outer chamber may be evacuated, or, in lieu of the phosphor coating, may be filled with another vapor, such as an inert gas and a gaseous phosphor to convert excimer UV radiation into visible emission.

Preferably, the excimer emission is at a low pressure, i.e., 1 to 5 Torr, from an excited discharge of metal halide vapors in a rare gas buffer atmosphere. Thus, a metal halide, in solid form, such as a few pellets of $AlCl_3$ is provided within the inner envelope along with a suitable buffer gas, such as Xe. The halide is heated to about 100° C. to produce aluminum trichloride ($AlCl_3$) vapors. A voltage applied across the electrodes causes a gaseous discharge to occur. The discharge dissociates the parent molecule $AlCl_3$ into many fragments, e.g., Al, $ALCL_n$(N=1,2),Cl. Some excited Xe* recombines with Cl and some other fragments (to conserve energy and momentum), and an excimer molecule, e.g., XeCl* results. The fragments in the discharge, particularly the metal vapor, help to sustain the discharge by providing a source of easily ionized metal vapor. The radiative reaction:

$$XeCl^* \xrightarrow{h\nu(308\ nm)} Xe + Cl$$

results in spontaneous emission of UV light in a band peaked near 308 nanometers. This radiation impinges on the phosphor in the outer envelope which, in turn, produces visible fluorescence.

*Is a superscript which indicates an excited state.

BEST MODE FOR CARRYING OUT THE INVENTION

Figure 1:
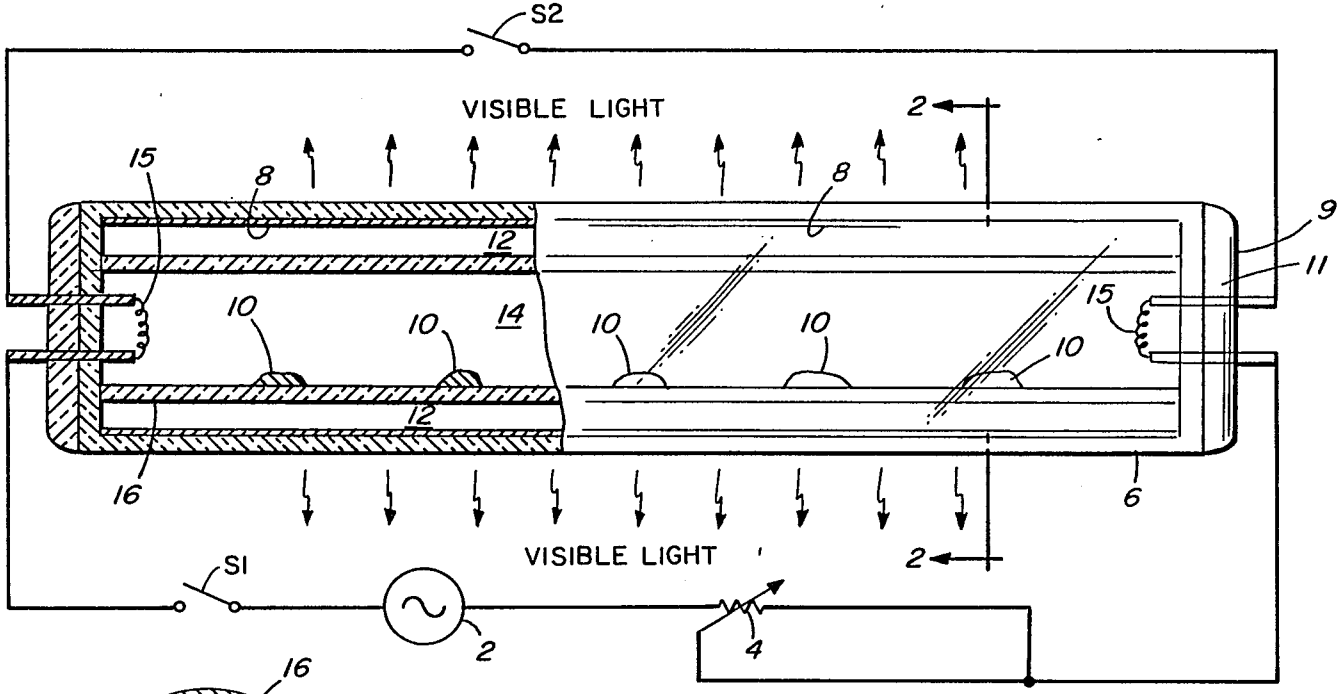
FIG. 1 is a perspective view of the incoherent excimer excited fluorescent light source of the invention with a portion broken away and including a schematic of the energization circuitry.
Figure 2:
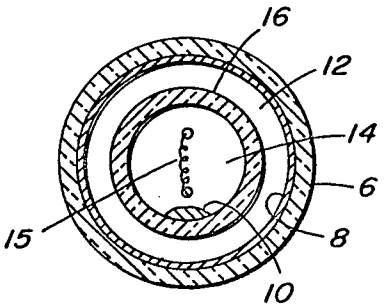
FIG. 2 is a cross-sectional view along the lines 2—2 of FIG. 1.

The preferred embodiment will now be described in connection with FIGS. 1 and 2. The lamp of the invention consists of a generally elongated tubular structure having an outer tubular envelope 6 which is internally coated with a phosphor 8. A suitable phosphor 8 may comprise calcium halophosphate or equivalent that is responsive to excimer UV radiation to produce visible fluorescence. Preferably outer envelope 6 is comprised of a soda-lime silicate glass having a low coefficient of absorption in the visible light region.

The outer glass envelope 6 is sealed at each end by glass stems 11. The sealed ends 11 of the envelope are fitted with base members 9 having contacts 13 that are connected to filamentary electron emitting electrodes 15 located in the central region 14 within the inner tubular transparent envelope 16. The electrodes 15 may comprise iridium (Ir) coated with thorium oxide ($ThO_2$) or thoriated iridium, i.e., iridium embedded with thorium; or other equivalent electron emitting electrodes capable of surviving the relatively corrosive environment present in inner chamber 14.

Envelope 16 is located coaxial to envelope 6 and is likewise sealed at both ends by end members 11. Envelope 16 may be formed of a glass or quartz material substantially transparent to UV radiation. The outer envelope, filled with an inert gas at low pressure, acts as a thermal barrier with the buffer gas serving as a limited variable thermal conductor which can be used to optimize temperatures within the inner chamber for a particular design.

It may thus be seen that an inner and outer chamber 12 and 14, respectively, are formed in accordance with the invention. Prior to enclosing the ends of the inner and outer chambers 12 and 14, a suitable halogen donor, preferably in the form of a pellet or pellets 10, is provided within the inner chamber 14. A suitable halogen donor is a solid metal halide, such as aluminum tri-chloride ($AlCl_3$). In addition, a buffer gas, such as inert gases Xenon, Krypton, Argon or Neon, at a pressure of 1 to 5 Torr is backfilled into the inner and outer chambers 14 and 12.

The lamp is energized in a two-step process involving a warm-up period followed by full-energization. In the first step, switches $S_1$ and $S_2$ are closed, permitting current from voltage source 2 to flow through filaments 15 and variable ballast impedance 4, for a period of time sufficient to establish a current flow of electrons between the two filaments 15 and to establish an initial discharge of the buffer gas in chamber 14, at which time, switch $S_2$ is opened permitting full current from the ballast circuit of voltage source 2 and impedance 4 to pass through the inner chamber, instead of the filament preheat circuitry. This prevents electrical energy from unnecessarily resistively heating the filaments once the discharge is fully established. Thereafter, ion bombardment from the discharge maintains the filaments at the elevated temperatures required for sustained thermionic emission. Switch $S_2$ may comprise a thermally activated switch, or may be mechanically formed, to automatically open once the warm-up period has been completed.

During warm-up, the initial discharge is basically a buffer gas discharge with little or no UV emission. This rather inefficient discharge rapidly heats the lamp and increases the temperature of inner wall 16. After a few minutes, an operating temperature of about 100° C. is reached. At this point, the metal halide vapors have sufficient vapor pressure to substantially contribute to the discharge. This results in a considerable increase in UV output, by virtue of the previously recited radiation reaction involving the spontaneous emission of 308 nm photons from excited state XeCl.

In accordance with the above, positive column discharges utilizing solid pellets of aluminum tri-chloride with both Xenon and Krypton buffer gases have been established near room temperature with low total pressures of 1 to 5 Torr to produce efficient excimer emission. Measured peak emission wavelengths of 300 nanometers for Xenon chloride and 202 nanometers for Krypton chloride are well within the absorption bands of the lamp phosphors 8.

The outer diameter to length ratio of the lamp of the invention may be similar to that of present day fluorescent lamps, i.e., in the order of 40 to 1.5. It should be noted, however, that lamp diameter is not restricted by self absorption considerations, as in mercury based discharge lamps, since there is no ground state self trapping of the excimer UV emission in the present apparatus. This is a consequence of the weakly bound or repulsive nature of the ground electronic state of excimer emissions. Therefore, compact fluorescent lamps may be made in accordance with the invention.

In the present apparatus, after radiative transitions from the excited to ground state, the excimer dissociates on a time scale of about $10^{-12}$ seconds. These time scales are sufficiently rapid to minimize reabsorption of the UV photons. Any secondary collisions with electrons or other particles further increases the dissociation rate. Consequently, no substantial ground state population can occur at low pressure to result in reabsorption of the UV emission.

EQUIVALENTS

This completes the description of the preferred embodiment of the invention. Those skilled in the art will recognize or be able to ascertain using no more than routine experimentation, other equivalents for the specific reactance and apparatus described herein. For example, in lieu of the solid phosphor coating 8, outer chamber 12 may include a gas which emits visible radiation in response to UV excimer emission. An iodine vapor and a buffer gas, such as Argon would emit green light upon absorption of UV emission by the iodine. Also, solid- metal halides, other than $AlCl_3$ are capable of producing UV radiation in the excited state, i.e., $HgCl_2$, $GaCl_3$, and $I_2$ gas, as well as the liquid phase metal halide $SnCl_4$. Such equivalents are intended to be included within the scope of the following claims.

We claim:

1. A light source comprising:

(a) a visible light transparent outer envelope containing fluorescent means for emitting visible light radiation upon absorption of UV emission; and (b) UV emission means for providing UV excimer emission within a separate inner envelope within said outer envelope for transmission through said separate inner envelope and absorption by said fluorescent means to produce visible illumination for passage through said outer envelope; said UV emission means comprising a metal halide and a buffer gas and an electrode means for creating an electrical discharge which excites the buffer gas and dissociates the metal halide and wherein molecules of said halide combine with molecules of the excited gas to produce an excimer, which upon decay, results in spontaneous emission of UV light.

2. The source of claim 1 wherein the metal halide is in the form of a solid or liquid which is heated to the point of vaporization.

3. The source of claim 2 wherein the metal halide is a compound taken from the class comprising $AlCl_3$, $HgCl_2$, $SnCl_4$ and $GaCl_3$.

4. A source of visible illumination comprising:

(a) ultraviolet emission means within a first envelope for generating spontaneous excimer ultraviolet emission from an electrical discharge between two electrodes in an enclosed atmosphere of metal halide vapors and an inert gas; and (b) visible emission means in a second envelope about said first envelope responsive to said ultraviolet emission for generating visible light and wherein a ballast circuit is coupled across said electrodes for providing a current flow through said electrodes to emit sufficient electrons to cause an electrical discharge through a buffer gas, bringing the buffer gas molecule to its excited state and heating an inner chamber to cause the metal halide to form metal halide vapors and wherein the metal halide is dissociated, and halide molecules combine with the excited state buffer gas molecules whereupon spontaneous excimer radiation at UV wavelength occurs.

5. The source of claim 4 wherein the visible emission means comprises:

(i) an outer envelope transparent to visible radiation surrounding said inner envelope and containing either phosphour material or iodine vapor for generating visible light in response to UV emission.

6. The source of claim 5 wherein the ballast circuit comprises a pair of switches in the circuit path of the two filamentary electrodes and the current flow, one of which is opened after initial discharge in the inner chamber is established.

7. The source of claim 4 in which the electrodes are formed of thorium and iridium.

8. The source of claim 4 in which the metal halide is taken from the class comprising $AlCL_3$, $HgCl_2$, $SnCl_4$ and $GaCl_3$.

9. The source of claim 5 wherein the material is a solid phosphor coated on the outer envelope wall.

10. The source of claim 5 wherein the material is a light emitting gas.

11. The source of claim 4 wherein the metal halide is $AlCl_3$, the inert gas is Xenon, and the peak emission has a wavelength of about 300 nanometers.

12. The source of claim 4 wherein the metal halide is $AlCl_3$, the inert gas is Krypton, and the peak emission has a wavelength of about 202 nanometers.

* * * * *